US012138526B2

(12) United States Patent
Bennett

(10) Patent No.: US 12,138,526 B2
(45) Date of Patent: Nov. 12, 2024

(54) UNIVERSAL ADAPTER ASSEMBLY FOR USE WITH POOL CUES

(71) Applicant: Michael Thomas Bennett, Bellingham, WA (US)

(72) Inventor: Michael Thomas Bennett, Bellingham, WA (US)

(73) Assignee: QCO, LLC, Middleton, WI (US)

( * ) Notice: Subject to any disclaimer, the term of this patent is extended or adjusted under 35 U.S.C. 154(b) by 660 days.

(21) Appl. No.: 17/167,695

(22) Filed: Feb. 4, 2021

(65) Prior Publication Data

US 2021/0236911 A1 Aug. 5, 2021

Related U.S. Application Data

(60) Provisional application No. 62/970,045, filed on Feb. 4, 2020.

(51) Int. Cl.
*A63D 15/12* (2006.01)

(52) U.S. Cl.
CPC ..... *A63D 15/12* (2013.01)

(58) Field of Classification Search
CPC ..... A63D 15/08–12
USPC ..... 473/49
See application file for complete search history.

(56) References Cited

U.S. PATENT DOCUMENTS 5,334,101 A * 8/1994 McDermott ..... A63D 15/08 473/44
5,514,039 A * 5/1996 Gendron ..... A63D 15/08 473/44
5,749,788 A 5/1998 Bourque
6,162,128 A 12/2000 McCarty
6,398,660 B1 * 6/2002 Probst ..... A63D 15/08 473/44
6,582,317 B2 * 6/2003 Pechauer ..... A63D 15/08 473/44
6,783,462 B1 * 8/2004 Costain ..... F16B 7/182 473/44
7,169,055 B2 1/2007 Mekosh
7,241,226 B2 * 7/2007 Costain ..... A63D 15/08 473/44
7,452,282 B2 11/2008 Gulyassy
9,962,600 B1 5/2018 Kalamdaryan
2002/0022529 A1 2/2002 Bourque
2003/0181255 A1 * 9/2003 Ho ..... A63B 60/54 473/316
2008/0026861 A1 1/2008 Costain
2008/0289669 A1 11/2008 Chiu
(Continued)

FOREIGN PATENT DOCUMENTS

JP 2005261600 A * 9/2005
KR 101894698 B1 * 4/2018
KR 102578609 B1 * 3/2022

*Primary Examiner* — Joshua T Kennedy
(74) *Attorney, Agent, or Firm* — CRGO Global; Steven M. Greenberg

(57) ABSTRACT

An adapter assembly for use in the cue/billiards sports. The adapter assembly includes a first part, also referred to as a sleeve, and a second part, referred to as an adapter. The adapter assembly inserts into a hollow cue shaft. When the first end of the adapter assembly is inserted into the hollow cue shaft, the adapter of the adapter assembly is configured to receive an insertion pin of a cue handle and to hold the cue handle in position relative to the cue shaft.

12 Claims, 7 Drawing Sheets

(56) References Cited

U.S. PATENT DOCUMENTS

| | | | |
|---|---|---|---|
| 2016/0184693 | A1 | 6/2016 | Gulyassy |
| 2021/0360909 | A1 | 11/2021 | Hughes |

* cited by examiner

UNIVERSAL ADAPTER ASSEMBLY FOR USE WITH POOL CUES

BACKGROUND

Technical Field

The present invention is directed to cue or billiard sports.

Description of the Related Art

Traditionally, cue sports use a long, semi-cylindrical stick, referred to as a cue, to strike a ball on a table, causing the ball to move. To ease transportation and storage of the cue when not in use, many cues employ a disconnecting mechanism or joint to allow them to be disassembled into two smaller pieces, generally referred to as the shaft and butt. Due to a lack of standardization combined with constant innovation, the joint can take many forms. The variety in joints leads to incompatibility between shafts and cue handles from differing manufacturers and periods of time.

BRIEF SUMMARY

The present disclosure is directed to a universal adapter assembly to allow interchangeability among various cue shafts and cue handles. The adapter assembly is a two-part design comprising first and second parts. The first part is fixed to the shaft, while the second part is one of various adapters designed to be compatible with cue handle joint mechanisms, such as insert pins of the cue handle, already existing in the market. Accordingly, the adapter assembly allows cue handles currently on the market to attach to any shaft. The adapter assembly eliminates the need for cue shaft makers to develop and maintain inventory for shafts to fit all types of insert pins of the cue handle joint mechanisms. Instead, manufacturers will only need adapter assemblies for each type of joint hardware. Furthermore, it will allow consumers to use their current cue handles joints with new shafts by simply obtaining the corresponding adapter portion (the second part) of the adapter assembly.

DETAILED DESCRIPTION

The present disclosure is directed to an adapter assembly to allow interchangeability among various shafts and cue handles to form a pool cue. Generally described, the adapter assembly is a two-part design comprising first and second parts. The first part is fixed to a cue shaft, while the second part is one of various adapters designed to be compatible with cue handles, such as insertion pins of cue handles, which already exist in the market. Accordingly, the adapter assemblies allow cue handles currently on the market to attach to any shaft. The adapter assemblies eliminate the need for cue shaft makers to develop and maintain inventory of shafts to fit all types of insertion pins of the cue handles. Rather, manufacturers or consumers will only need various adapter assemblies that are compatible for the respective insertion pins. The present disclosure allows consumer to use any cue handle with a particular insertion pin with various cue shafts by simply obtaining the corresponding adapter assembly.

Figure 1A:
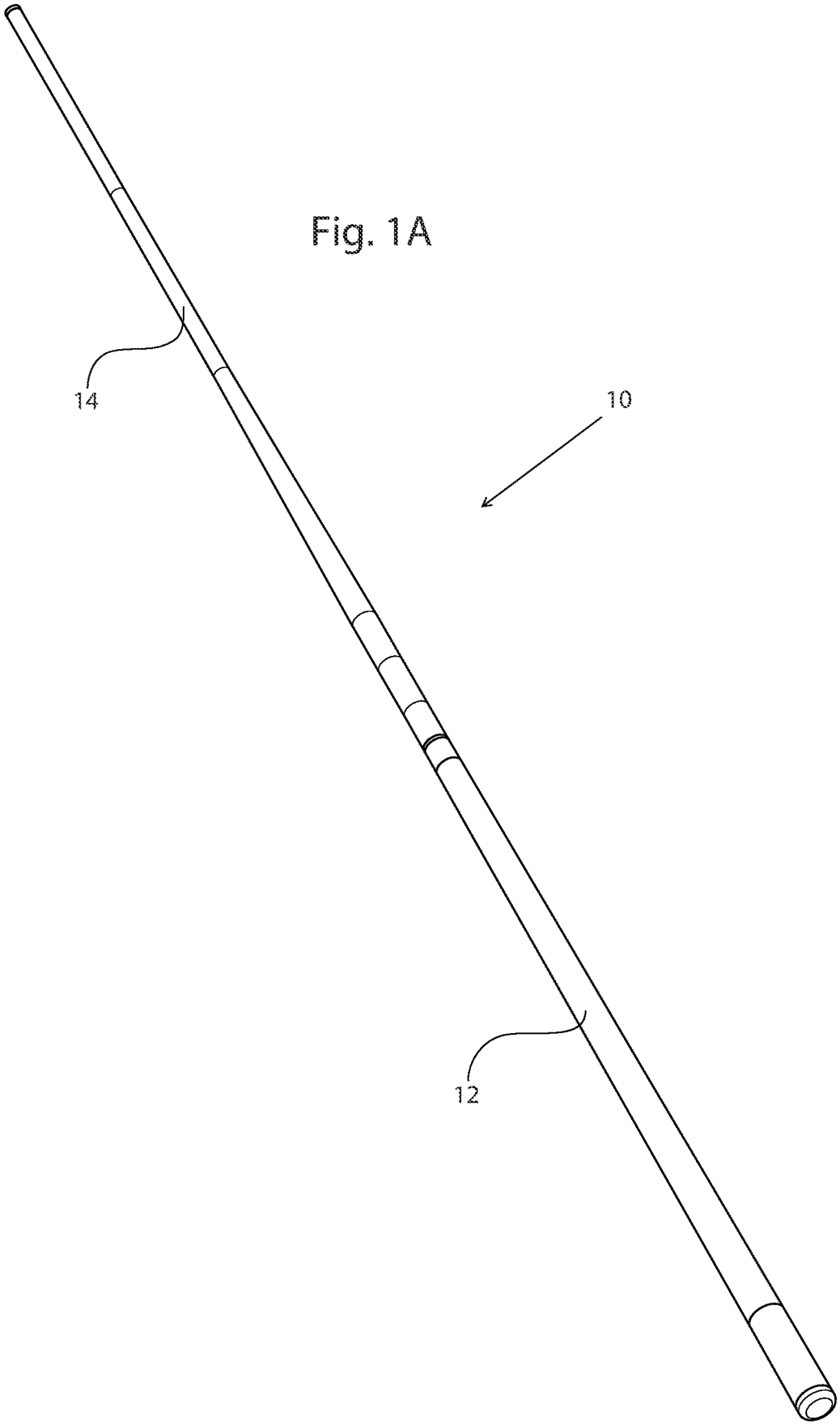
FIG. 1A shows a pool cue with a cue handle and a cue shaft in an assembled state.
Figure 1B:
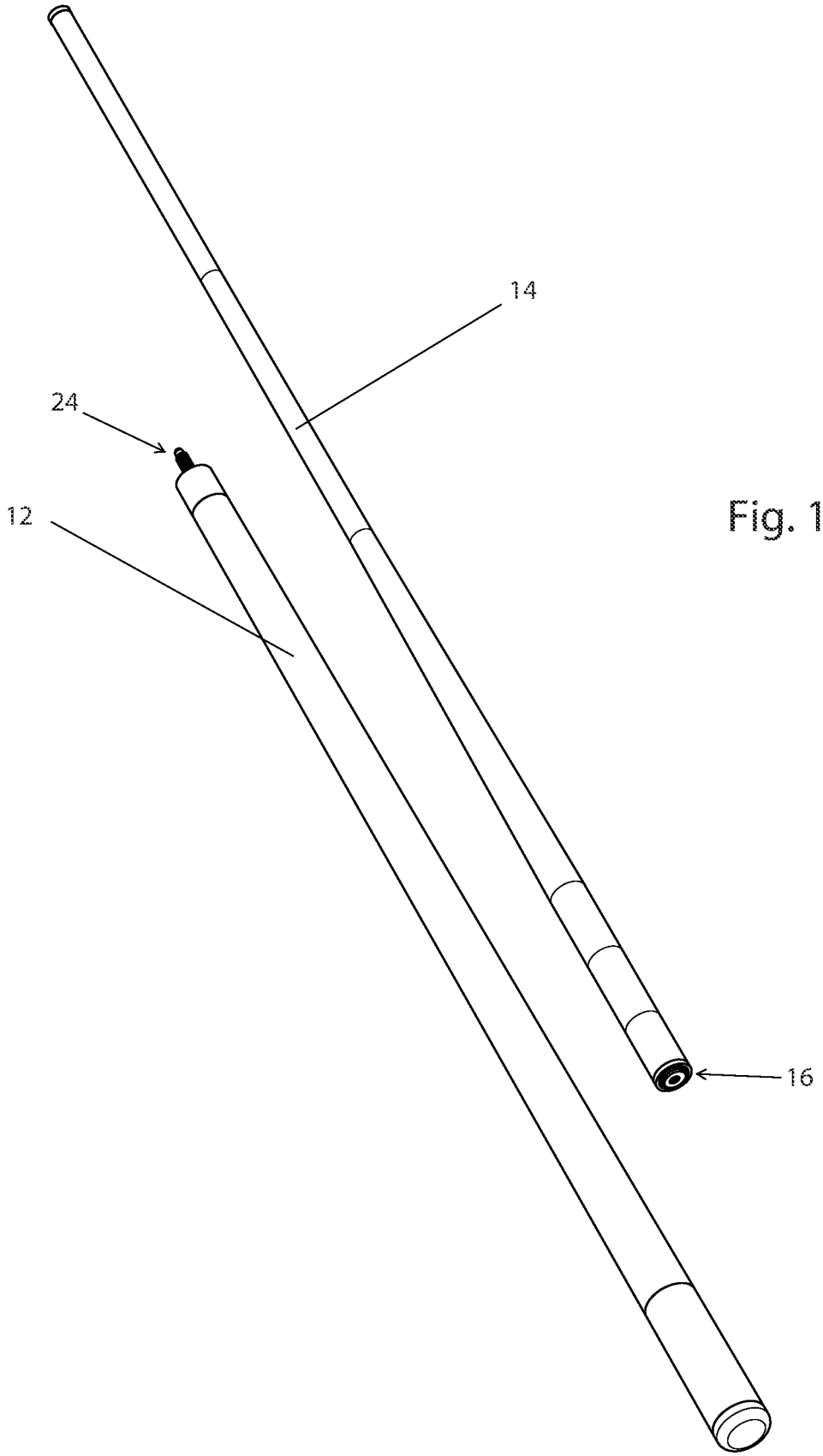
FIG. 1B shows the pool cue with the cue handle and cue shaft in an unassembled state.

FIG. 1A shows a cue handle and shaft assembly 10 in an assembled state, while FIG. 1B shows the cue handle and shaft assembly 10 in an unassembled state such that a cue handle 12 is separated from a cue shaft 14. The cue shaft 14 includes an adapter assembly 16 for coupling a cue handle insertion pin 24 the cue shaft 14 to the cue handle 12.

Figure 2A:
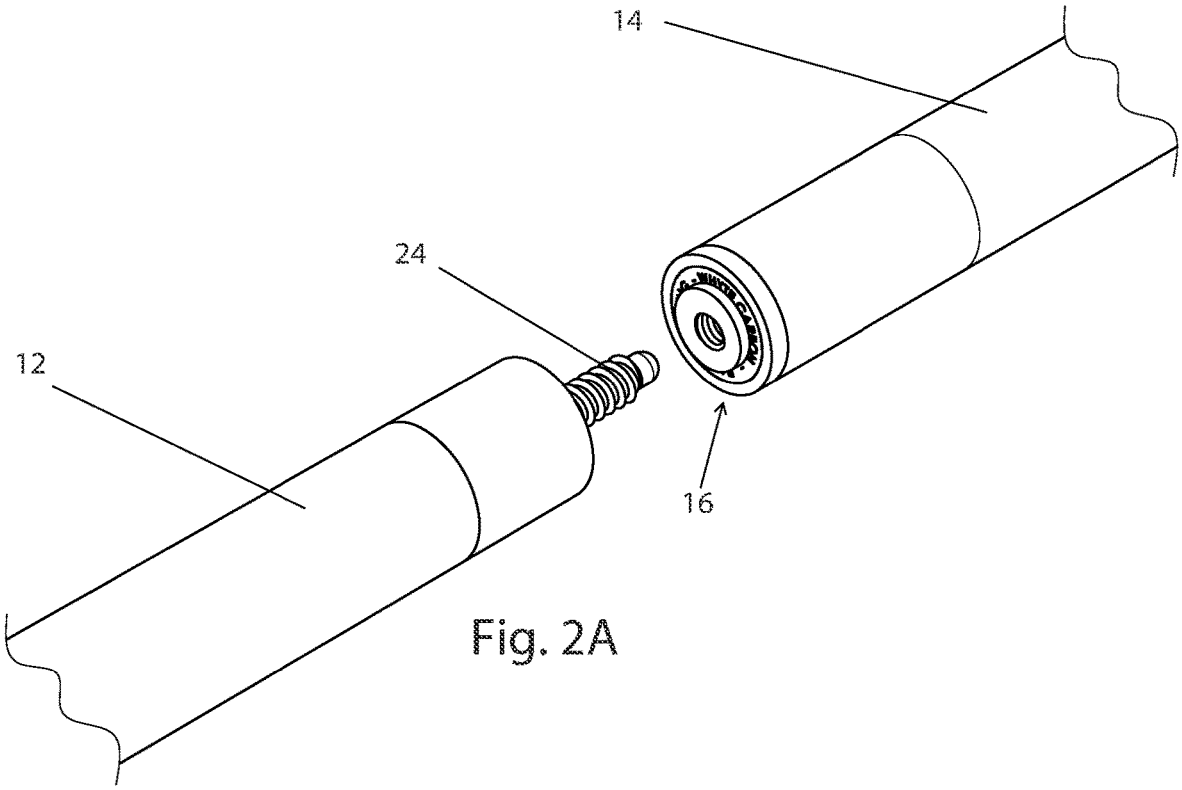
FIG. 2A shows a partial close-up of the pool cue in the unassembled state.
Figure 2B:
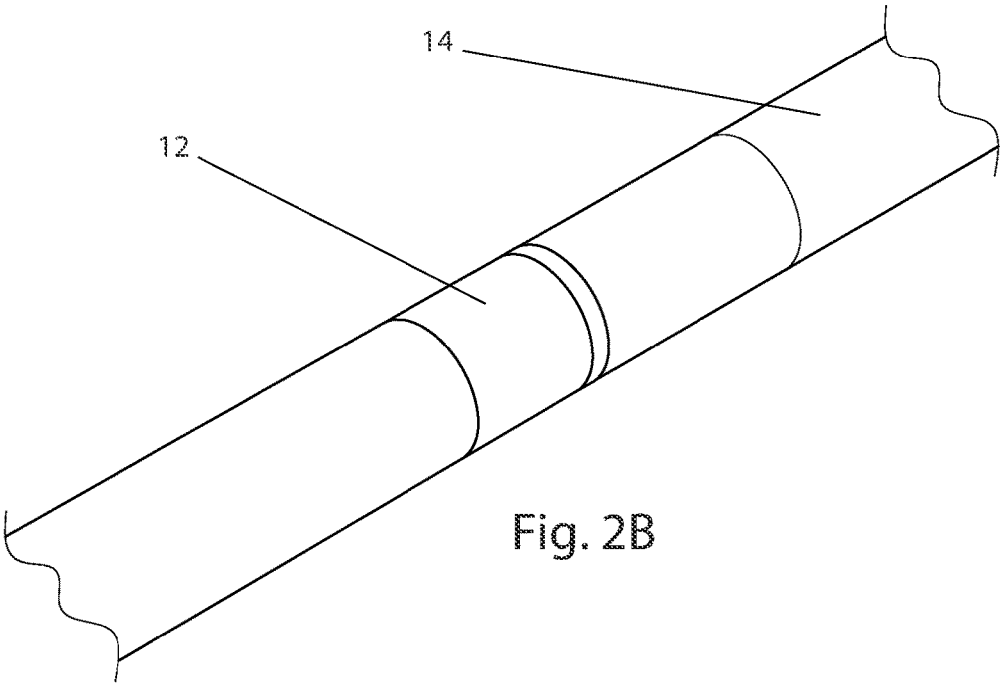
FIG. 2B shows a partial close-up of the pool cue with the cue handle and shaft in the assembled state.
Figure 2C:
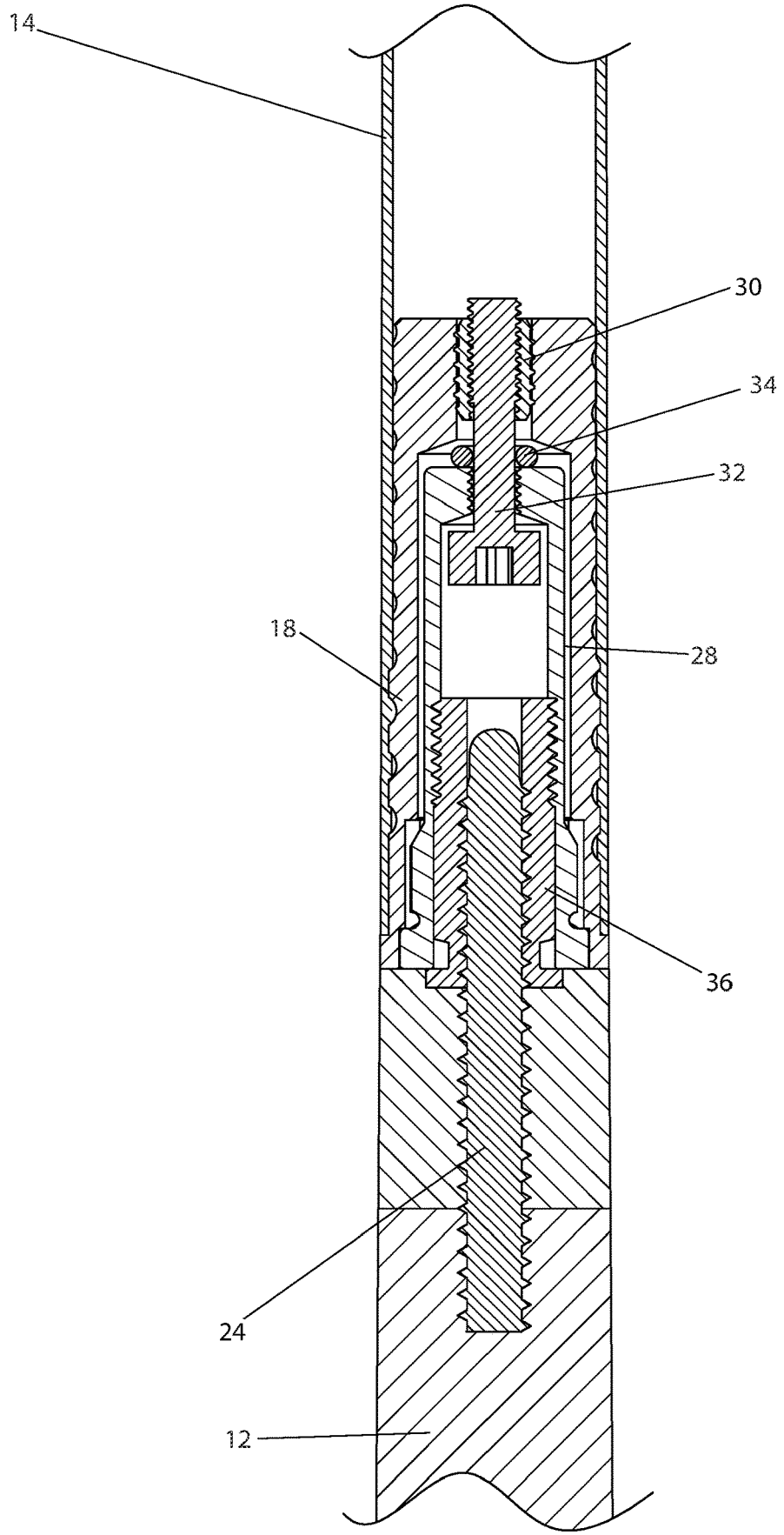
FIG. 2C shows a cross sectional of partial close-up of the pool cue of FIG. 2B.

FIG. 2A shows a partial close-up of the joint between the cue handle and shaft assembly 10 in the unassembled state. FIG. 2B shows a partial close-up of the pool cue with the cue handle and shaft assembly 10 in an assembled state, while FIG. 2C shows a cross sectional view of partial close-up of the cue handle and shaft assembly 10 of FIG. 2B in the assembled state.

The cue handle 12 includes cue handle insertion pin 24 of a particular shape and size, such as the shape and size of the pin and threads. The cue shaft 14 includes an adapter assembly 16 that corresponds to the cue handle insertion pin 24 of the cue handle 12. The adapter assembly 16 has a first end and a second end. The first end of the adapter assembly 16 is inserted into the hollow cue shaft 14 and the second end of the adapter assembly 16 is at the endface of the cue shaft 14. The adapter assembly 16 has a first part, referred to as a sleeve 18, and a second part, referred to as an adapter 20. The sleeve 18 receives the adapter 20 to form the adapter assembly 16. The sleeve 18 is configured to receive various adapters 20.

When the first end of the adapter assembly 16 is received in the hollow cue shaft 14, a portion of an end surface at the second end of the adapter assembly 16 is flush or coplanar with an end surface of the cue shaft 14, as best shown in FIG. 2A. The adapter 20 of the adapter assembly 16 is configured to receive a cue handle insertion pin 24 of a cue handle 12 and to hold the cue handle 12 in a fixed position relative to the cue shaft 14. In particular, the cue handle insertion pin 24 includes threads that threadly couple to the threads of a respective adapter 20.

Figure 3A:
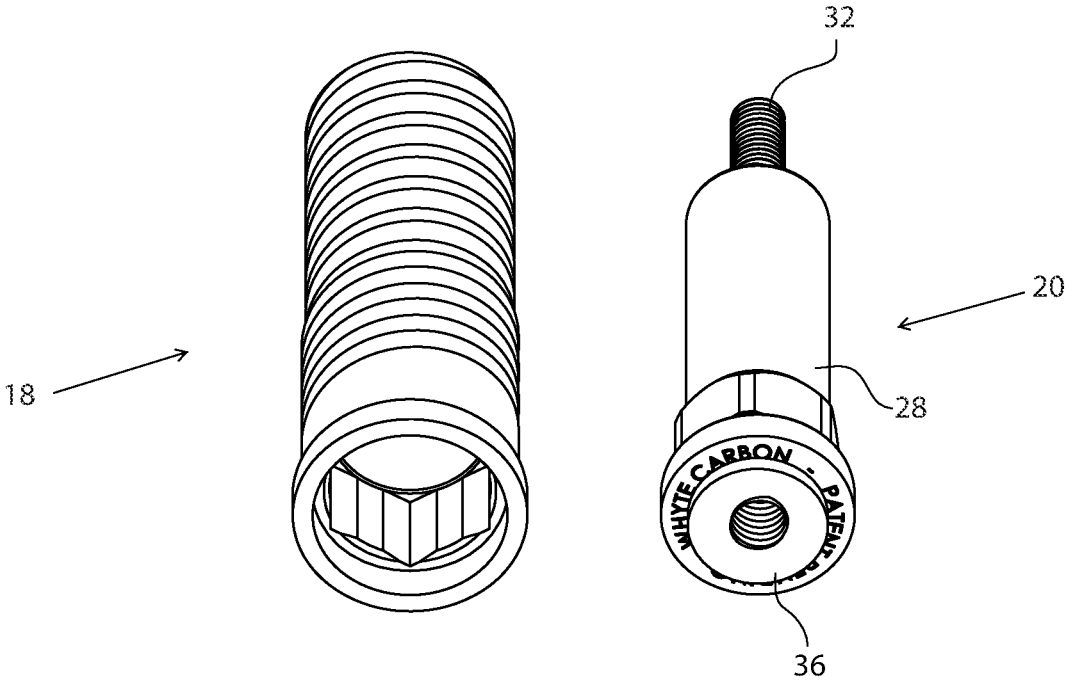
FIG. 3A shows a front isometric view of the adapter assembly with the sleeve separated from the adapter.
Figure 3B:
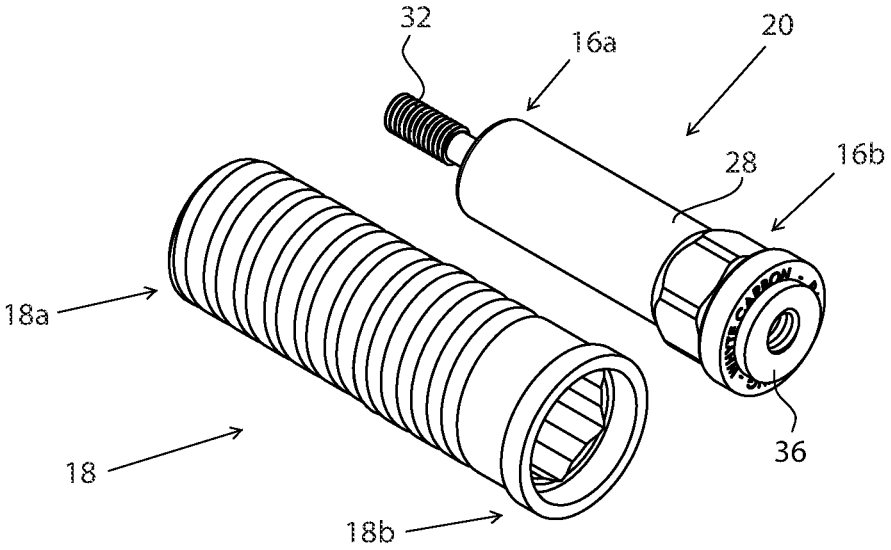
FIG. 3B shows a side, front isometric view of the adapter assembly with the sleeve separated from the adapter.
Figure 3C:
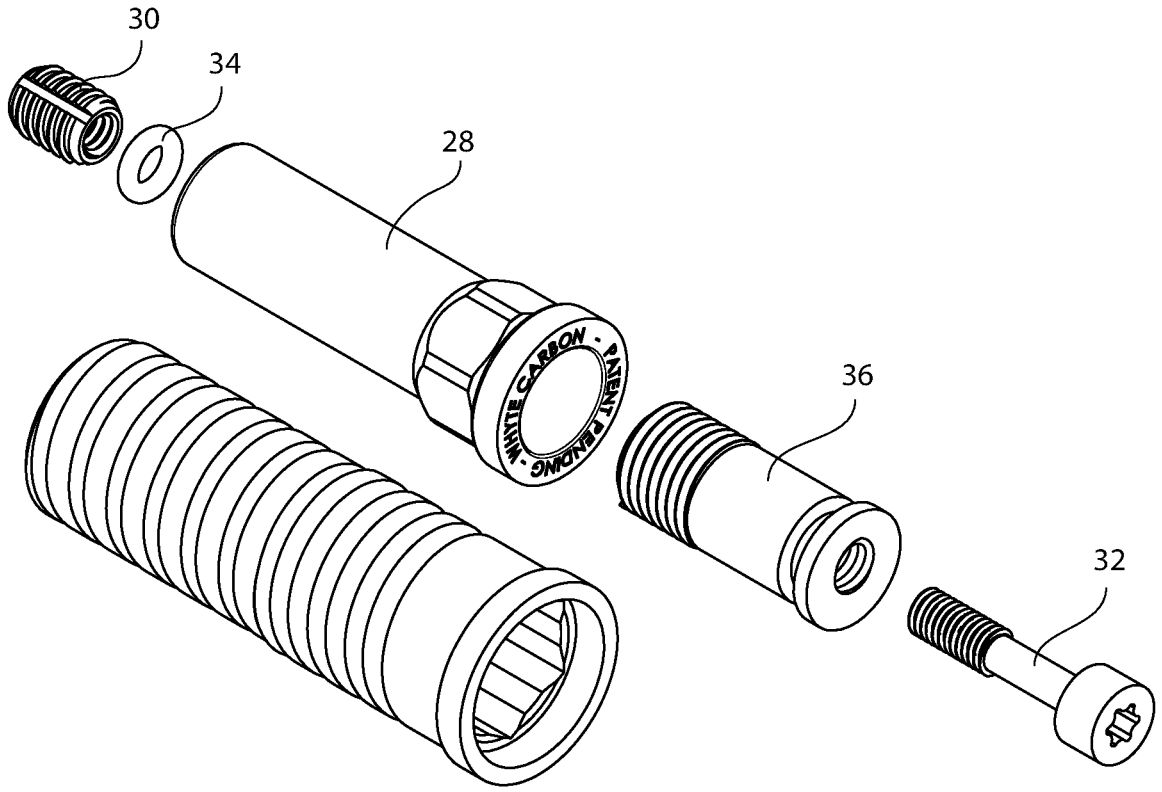
FIG. 3C shows components of the adapter in exploded view.

FIG. 3A shows a front isometric view of the adapter assembly with the sleeve 18 separated from the adapter 20. FIG. 3B shows a side, front isometric view of the adapter assembly with the sleeve separated from the adapter. FIG. 3C shows components of the adapter in exploded view. The sleeve 18 is a hollow tube and includes a first end 18*a* and a second end 18*b*. The outer surface of the sleeve 18 couples to an inner surface of a hollow cue shaft 14, such as a carbon fiber cue shaft. In particular, the first end 18*a* of the sleeve 18 inserts into hollow cue shaft 14 so that the second end 18*b* of the sleeve 18 is flush with an end face of the cue shaft 14. The sleeve 18 may be coupled to the inner surface of the hollow cue shaft 14 by an adhesive material, such as glue, epoxy, resin, or any other suitable adhesive material. The sleeve 18 may be made of any suitable material that is configured to couple to the cue shaft 14 and to hold the adapter 20. For instance, the sleeve 18 may be linen phenolic, resin, thermoplastic, carbon fiber material, or any other suitable material.

The second end 18*b* of the sleeve 18 includes a hex shape at the internal surface and a recess. The hex shape of the second end 18*b* of the sleeve 18 mates with a corresponding hex shape of the adapter 20. That is, a second end of the adapter 20 includes a hex shape at its outer surface that mates with the hex shape of the second end 18*b* of the sleeve 18. The mated hex shapes of the sleeve 18 and the adapter 20 prevent or limit the adapter from rotating relative to the sleeve 18 when the adapter 20 is located in the sleeve 18. Furthermore, the hex shapes provide alignment when installing the adapter in the sleeve. Although hex shapes are shown, it is to be appreciated that any shapes that limit rotation between the second ends of the adapter 20 and the sleeve 18 when the adapter is located in the sleeve may be used. Accordingly any suitable shape or number of flat edges may be used to prevent movement between the sleeve and the adapter and to align the adapter relative to the sleeve.

As will be explained in more detail below, the second end 16*b* of the adapter 20 includes a lip that corresponds with the recess of sleeve 18 and a hex shape that corresponds to the hex shape of the second end 18*b* of the sleeve 28. The lip of adapter 20 is configured to rest in the recess of the sleeve 18 when the adapter 20 is installed in the sleeve 18 thereby forming the adapter assembly 16. When the sleeve is installed in the cue shaft 14, the second end 16*b* of the sleeve 18 is flush with an end of the cue shaft 14.

With reference to FIGS. 2C and 3C, the adapter 20 includes a housing 28 having a first end and a second end. The outer surface of first end of the housing 28 includes the hex shape discussed above for engaging with the internal surface of sleeve 18, when the adapter 20 is located in the sleeve. The adapter 20 further includes a retainer screw 32, a threaded insert 36, an O-ring or E-ring 34, and a double threaded nut 30.

The first end 16*a* of the housing 28 of the adapter 20 includes threads that may be threadedly couplable with the retainer screw 32. After the threads of the retainer screw 32 pass by the threads of the sleeve 18 as shown in FIG. 3C, the retainer screw 32 is coupled to threads of a double threaded nut 30 of the adapter 20. The outer threads of the double threaded nut 30 mate with corresponding internal threads of the sleeve 18. The double threaded nut 30 is fixed to the housing 28 of the adapter 20, which may be by glue, epoxy, resin, or any other suitable adhesive material configured to hold the retainer screw 32 in place. The threads of the first end 16*a* of the housing 28 aid in holding the retainer screw 32 in position. The double threaded nut 30 includes outer threads and internal threads. The retainer screw 32 may be made of metal. Although a screw and threads are described herein for coupling the adapter to the sleeve, any mechanical coupling between the adapter and the sleeve may be used.

Accordingly, the retainer screw 32 of the adapter 20 holds the first end of the adapter 20 in the sleeve 18. More particularly, the second end of the housing 28 of the adapter 20 may include the threads so that the retainer screw 32 can be coupled to the housing 28 by threaded coupling, then once the threads of the retainer screw 32 pass through the threads of the housing 28 of the adapter, the retainer screw 32 is held in an opening at the second end of the adapter but able to rotate therein.

In some embodiments, the threaded insert 36 is not used and the retainer screw 32 mate directly with the internal threads of the sleeve 18 at the second ends. Accordingly, internal threads at the second end of the sleeve 18 are formed integrally with an inner surface of the sleeve 18.

The O-ring or E-ring 34 aids in holding the retainer screw in the longitudinal direction in the adapter 20 and may aid in pushing the adapter 20 away from the sleeve 18 when the retainer screw 32 is threadedly decoupled from the housing 28.

The threaded insert 36 includes a cue insert opening configured to receive the cue handle insertion pin 24 of a particularly sized cue handle 12 and to thereby secure the cue handle 12 to the cue shaft 14. Size of the cue insert opening of the threaded insert 36 may refer to the diameter of the opening, the threads, or both. The cue insert opening of the threaded insert 36 opening includes threads that threadly couple to the cue handle insertion pin 24 of the cue handle 12. Thus, when the adapter 20 is secured to the sleeve 18 in the adapter assembly 16 and the cue handle insertion pin 24 is in the threaded insert 36 of the adapter assembly 16, the cue handle 12 is thereby secured to the cue shaft 14. In at least one embodiment, the threaded insert 36 is made of a metal material.

The threaded insert 36 has outward threads that threadedly couple with the internal threads housing 28 of the adapter 20. In some embodiment, an adhesive material is used between the threaded insert 36 and the housing 28 of the adapter 20 to aid the coupling there between. For instance, in one embodiment, an epoxy is used between the outer surface of threaded insert 36 and inner surface of the housing 28 of the adapter 20 that improves the coupling between the corresponding threads.

The threaded insert 36 at the second end of the housing 28 of the adapter 20 includes internal threads configured to mate with a particular insertion pin of a cue handle 12, and the sleeve 18 is configured to receive various adapters 20, each having various sized threaded inserts that mate with various insertion pins 24. That is, the sleeve 18 is configured to receive various adapters 20 each with a specific threaded insert 36 that is configured to mate with a respective insertion pin 24 of a cue handle 12 and hold a surface of the cue handle 12 flush with a surface of the cue shaft 14. Accordingly, a cue shaft 14 that includes a sleeve may be used with various adapters so that the cue shaft couples to various cue handles.

As shown in FIG. 2C, the threaded insert 36 may include an extension portion that extends beyond the endface of the housing 28. The extension portion is configured to engage with an insertion pin of a cue handle 12. That is, the extension portion is configured to be received in a recess of the cue handle.

The adapter 20 is coupleable to and removable from the sleeve 18 by the retainer screw 32. That is, by rotating the retainer screw 32 of the adapter 20 relative to the double threaded nut 30 in a first direction, such as clockwise, the adapter 20 coupled to the sleeve 18. By rotating the retainer crew 32 of the adapter 20, relative to the double threaded nut 30 in a second opposite direction, such as counterclockwise, the adapter 20 may be removed from the sleeve 18. To assist a user in rotating the retainer screw 32 into the double threaded nut 30, a user may use a suitable wrench that extends into the opening of the adapter 20 to couple with a head of the retainer screw 32 of the adapter 20 thereby removing the retainer screw 32 and the adapter 20 from the cue shaft 14. Furthermore, when the retainer screw 32 is decoupled from the double threaded nut 30, the O-ring or the E-ring 34 aids in pushing the adapter 20 in the longitudinal direction and thus outward from the sleeve 18 to aid a user in removing the adapter 20 from the sleeve 18.

When the adapter 20 is located in the sleeve 18 to form the adapter assembly 16, the hex shape of the adapter assembly 16 is located in the hex shape of the sleeve 18, and the lip of the adapter assembly 16 rests in the recess of the sleeve 18. The hex shapes hold the second ends of adapter 20 relative to the sleeve 18. Although some movement is allowed, the adapter 20 is prevented from or limited in rotating relative to the sleeve 18 at the second end, thereby strengthening the coupling between the two at the first end. Thus, while the adapter 20 is coupled to the sleeve 18 at the first end by threaded coupling, the second end of the adapter assembly 16 is prevented from rotating within the sleeve 18.

Figure 4:
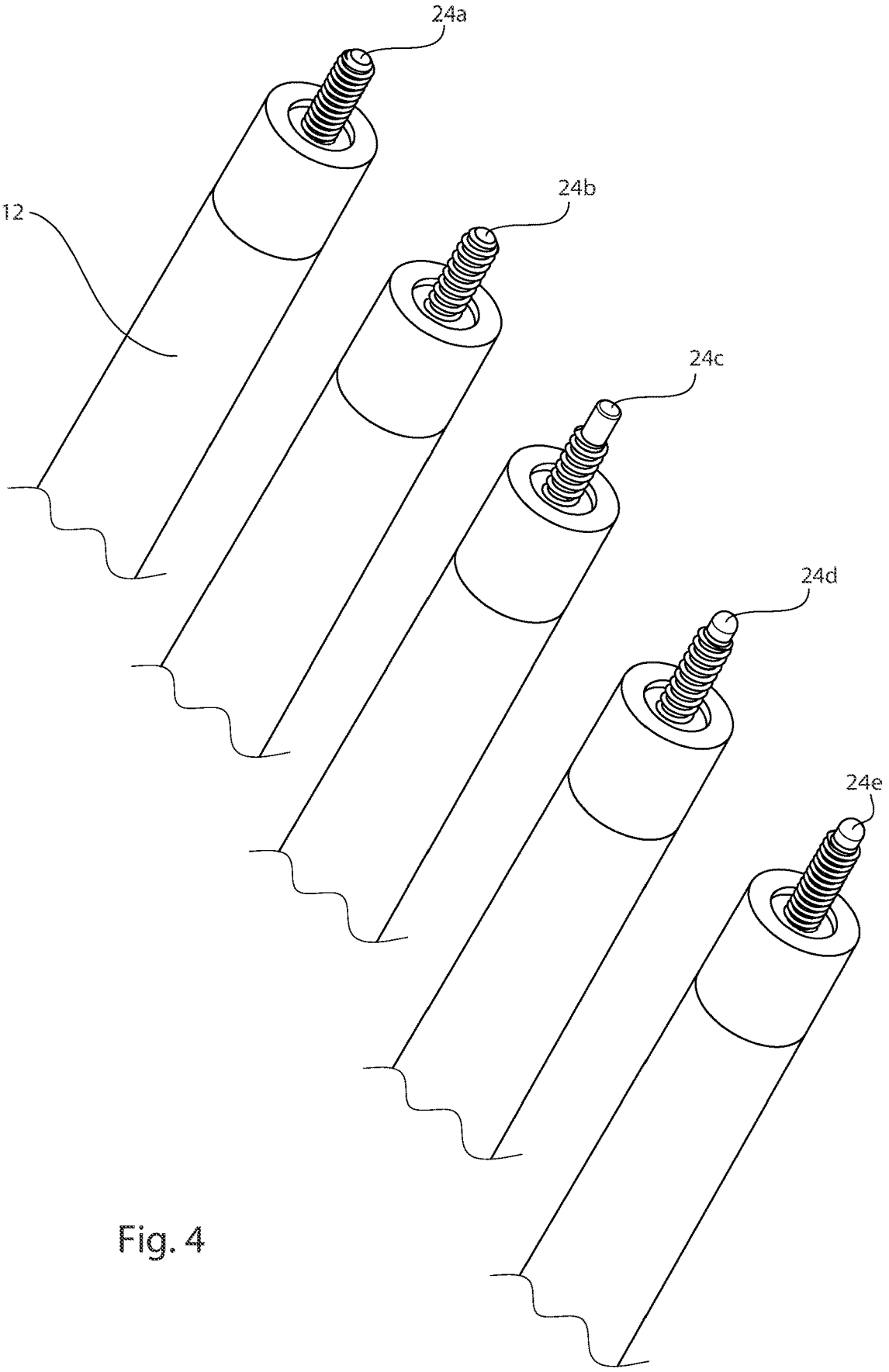
FIG. 4 shows various cue handles 12 with different cue handle threaded pins 24.

FIG. 4 shows various cue handles 12 with different cue handle insertion pins 24*a*, 24*b*, 24*c*, 24*d*, 24*e*. The cue handle insertion pins 24 may have different thread sizes, lengths, or diameters. Various adapters, each having different cue insert openings may be used with a single sleeve that is coupled to a cue shaft. Each adapter may be substantially identical except for the size of the opening and/or threads of the threaded insert. It is to be appreciated that various adapters may be placed inside the sleeve to obtain an adapter assembly in an assembly state. The various adapters each have different sized cue insert openings such that different sized insertion pins are configured to be held therein. Thus, when a user wants to use a cue handle of a different size, the user may decouple a first adapter from the sleeve 18 as described above and coupled a second adapter into the sleeve. The first adapter has threaded insert configured to mate with the insertion pin 24*a*, while the second adapter has a threaded insert configured to mate with the insertion pin 24*b*. Accordingly, a user will be able to use various sized insert pins of the cue handles with different adapters and a single cue shaft and sleeve.

The adapter components are made of any material configured to mate with the sleeve and to hold a cue handle. In many embodiments, the adapter components are made of metal, such as stainless steel, aluminum, titanium, or tungsten. In other embodiments, the adapter components are made of a synthetic material, such as carbon fiber, Polyoxymethylene (POM), such as Delrin, a fiber reinforced phenolic, etc. A portion, or all, of the diameter of the opening in the adapter may be increased or decreased to modify the weight of the adapter, which thereby modifies the weight of the adapter assembly. For instance, the diameter of the opening of the adapter at a middle portion of the adapter may be increased or decreased. By modifying the weight of the adapter assembly, the weight of a pool cue that utilizes the adapter assembly may be adjusted. By being able to modify the weight of a pool cue based on the adapter assembly being used provides a user with more control of the weight and balance of the pool cue. For instance, adapters may be controllable by providing a plurality of different weights.

In one embodiment, a thickness of the sleeve is greater at the first end than at the second end such that an opening proximate the second end is greater than an opening proximate the second end. By having a greater thickness of the sleeve at the second end, weight associated with the threaded insert is also maintained closer to the center of the cue shaft.

To prevent unwanted rotation between the first and second parts of the adapter assembly, an interlocking design is used. This may include, but is not limited to a pin/socket, slot/key, interlocking facet, or any other structure that prevents or limits rotation between two mated parts. To ensure proper alignment, the first and second parts have alignment features at both ends. In Cue/Billiards Sports, players may develop different preferences regarding the weight of the cue. The parts of the adapter assemblies can be designed with different materials and geometries to accommodate these preferences.

The embodiments improve on current cue joint by introducing a method for universal compatibility and adaptability among various existing cue handles and newly created adapter assemblies for use with cue shafts.

One or more embodiments provide inexpensive and rapid interchangeability among currently incompatible cue shafts and cue handles and/or coaxial alignment between the cue shaft and cue handles, creating a straight and "true" cue. Furthermore, one or more embodiments prevent unwanted rotation between the cue shaft and cue handle. Furthermore, one or more embodiments, allow weight customization to accommodate player preferences.

Broadly described is a two-part adapter, with one part built into a cue shaft and the other part consisting of a variety of adapters designed to fit joint hardware commonly found on existing cue handles.

The above description and corresponding figures enable a person of ordinary skill and adequate resources to make and use the present invention. As such, said person of ordinary skill and adequate resources will also recognize the existence of variations and equivalents of the embodiments explained and illustrated herein.

Subsequently, the invention must not be limited by the embodiments explained and illustrated herein, but by all embodiments and methods within the scope and spirit of the invention as described and illustrated here.

The invention claimed is:

1. A pool cue assembly, comprising: a first cue handle having an insertion pin of a first size;

an adapter assembly; and a cue shaft that is removably coupled to the cue handle by the adapter assembly, the adapter assembly including a sleeve coupled to an inner surface of the cue shaft, wherein the adapter assembly includes a first adapter having an opening that receives and mates with the insertion pin of the first cue handle, wherein the sleeve is fixed to the cue shaft, and wherein the first adapter is removable from the sleeve;

wherein an end of the sleeve includes a first internal polygonal shape while a remaining portion of the sleeve has a first cylindrical shape, wherein an end of the first adapter includes a housing having a second external polygonal shape, wherein the first internal polygonal shape of the sleeve provides alignment and limits rotation of the first adapter wherein when the adapter assembly is in an assembled state, a retaining screw holds the first adapter to the sleeve and is a separate screw which is rotatable relative to the first adapter and is threadably connected to the sleeve to secure the first adapter to the sleeve.

2. The pool cue assembly of claim 1, wherein the opening of the first adapter includes a threaded insert that corresponds to a thread size of the insertion pin of the first cue handle.

3. The pool cue assembly of claim 1, wherein the sleeve is fixed to the cue shaft by at least one of glue, epoxy, resin, or adhesive.

4. The pool cue assembly of claim 1, wherein the first adapter is mechanically coupled with the sleeve at a first end.

5. The pool cue assembly of claim 1, further comprising a second adapter configured to couple to the sleeve of the adapter assembly, wherein the second adapter has an opening that mates with the insertion pin of a second cue handle, wherein the opening of the second adapter is of a different size than the opening of the first adapter.

6. The pool cue assembly of claim 1, further comprising a second adapter configured to couple to the sleeve of the adapter assembly, wherein the second adapter has an opening that mates with the insertion pin of a second cue handle, wherein the insertion pin of the second cue handle is of a different size than the insertion pin of the first cue handle.

7. The pool cue assembly of claim 1, wherein the first adapter includes an O-ring or an E-ring that aids in holding the first adapter assembly in a longitudinal direction relative to the sleeve.

8. The pool cue assembly of claim 1, wherein the first adapter includes a threaded insert that has the opening that mates with the insertion pin of the first cue handle.

9. An adapter assembly, comprising:

an adapter and a sleeve, wherein the sleeve is configured to be coupled to an end of a cue shaft, wherein the sleeve includes an internal polygonal shape that mates with an external polygonal shape of the adapter that prevents the adapter from rotating relative to the sleeve in at least one direction, wherein the adapter assembly is configured to be placed in an assembled state and an unassembled state, wherein when the adapter assembly is in the assembled state, the adapter is fixed to the sleeve, wherein the adapter has an opening configured to receive an insertion pin of a cue handle and thereby couple the cue shaft to the cue handle, and wherein when the adapter assembly is in the unassembled state, the adapter is uncoupled from the sleeve and from the cue shaft, but when the adapter assembly is in the assembled state, a retaining screw holds the adapter to the sleeve and is a separate screw which is rotatable relative to the adapter and is threadably connected to the sleeve to secure the adapter to the sleeve.

10. The adapter assembly of claim 9, wherein when the adapter assembly is in the assembled state, the adapter is fixed to the sleeve by threaded coupling.

11. The adapter assembly of claim 9, wherein the adapter is a first adapter having a threaded opening of a first size, wherein the adapter assembly includes a second adapter having a threaded opening of second size that is different from the first size.

12. The adapter assembly of claim 11, wherein the first and second adapters are configured to be removably coupled to the sleeve.

* * * * *